US008911179B2

(12) United States Patent
Noble et al.

(10) Patent No.: US 8,911,179 B2
(45) Date of Patent: Dec. 16, 2014

(54) DUAL-DERRICK ICE-WORTHY JACK-UP DRILLING UNIT

(75) Inventors: Peter G. Noble, Spring, TX (US); Randall S. Shafer, Houston, TX (US); Dominique P. Berta, Katy, TX (US); Yew Yuen Chow, Houston, TX (US); Tak On Cheung, Sugarland, TX (US); Kok Seng Foo, Singapore (SG); Chin Kau Quah, Singapore (SG); Cynthia Wang, Singapore (SG)

(73) Assignees: ConocoPhillips Company, Houston, TX (US); Keppel Offshore & Marine Technology, Singapore (SG)

( * ) Notice: Subject to any disclaimer, the term of this patent is extended or adjusted under 35 U.S.C. 154(b) by 104 days.

(21) Appl. No.: 13/396,457

(22) Filed: Feb. 14, 2012

(65) Prior Publication Data

US 2013/0101357 A1 Apr. 25, 2013

Related U.S. Application Data

(63) Continuation of application No. PCT/SG2011/000369, filed on Oct. 21, 2011.

(60) Provisional application No. 61/405,497, filed on Oct. 21, 2010.

(51) Int. Cl.

| | |
|---|---|
| ***E02B 17/08*** | (2006.01) |
| ***E02B 17/00*** | (2006.01) |
| ***E02B 17/02*** | (2006.01) |
| ***E21B 7/00*** | (2006.01) |
| ***E21B 15/02*** | (2006.01) |
| *B63B 35/08* | (2006.01) |

(52) U.S. Cl.

CPC ..... *E02B 17/0021* (2013.01); *E02B 17/021* (2013.01); *E21B 7/008* (2013.01); *E21B 15/02* (2013.01); *B63B 35/08* (2013.01); *E02B 2017/0039* (2013.01); *E02B 2017/006* (2013.01); *E02B 2017/0082* (2013.01)

USPC ..... 405/217; 405/196; 405/203; 405/211

(58) Field of Classification Search

USPC ..... 405/196–200, 203, 211, 217, 224

See application file for complete search history.

(56) References Cited

U.S. PATENT DOCUMENTS

| | | | | |
|---|---|---|---|---|
| 4,102,144 | A * | 7/1978 | Anders | 405/211 |
| 4,586,872 | A | 5/1986 | Corzilius | |

(Continued)

FOREIGN PATENT DOCUMENTS

| | | |
|---|---|---|
| EP | 1094193 | 4/2001 |
| FR | 2528465 | 12/1983 |

(Continued)

OTHER PUBLICATIONS

Guidance Notes on Ice Class, published by American Bureau of Shipping Incorporated by Act of Legislature of the State of New York 1862 (2008).

Requirements concerning Polar Class, by International Association of Classification Societies (2011).

*Primary Examiner* — Tara M. Pinnock

(74) *Attorney, Agent, or Firm* — Boulware & Valoir

(57) ABSTRACT

The invention relates to a jack-up rig. The inventive rig would work like a conventional jack-up rig while in open water with the hull jacked up out of the water. However, in the event of ice conditions, the hull is lowered into the water into an ice defensive configuration. The hull is specifically shaped with a lower portion that is an ice-bending surface to bend and break up ice that comes in contact with the hull while in the ice defensive configuration. Furthermore, the jack-up rig comprises at least two derricks.

5 Claims, 8 Drawing Sheets

(56) References Cited

U.S. PATENT DOCUMENTS

| | | | | |
|---|---|---|---|---|
| 4,602,895 | A | 7/1986 | Wilkman | |
| 4,819,730 | A * | 4/1989 | Williford et al. | 166/355 |
| 6,491,477 | B2 | 12/2002 | Bennett et al. | |
| 7,628,224 | B2 * | 12/2009 | D'Souza et al. | 175/5 |
| 2008/0237173 | A1 * | 10/2008 | Altman et al. | 212/347 |

FOREIGN PATENT DOCUMENTS

| | | |
|---|---|---|
| GB | 2079826 | 1/1982 |
| WO | PCT/SG2011/000369 | 10/2011 |

* cited by examiner

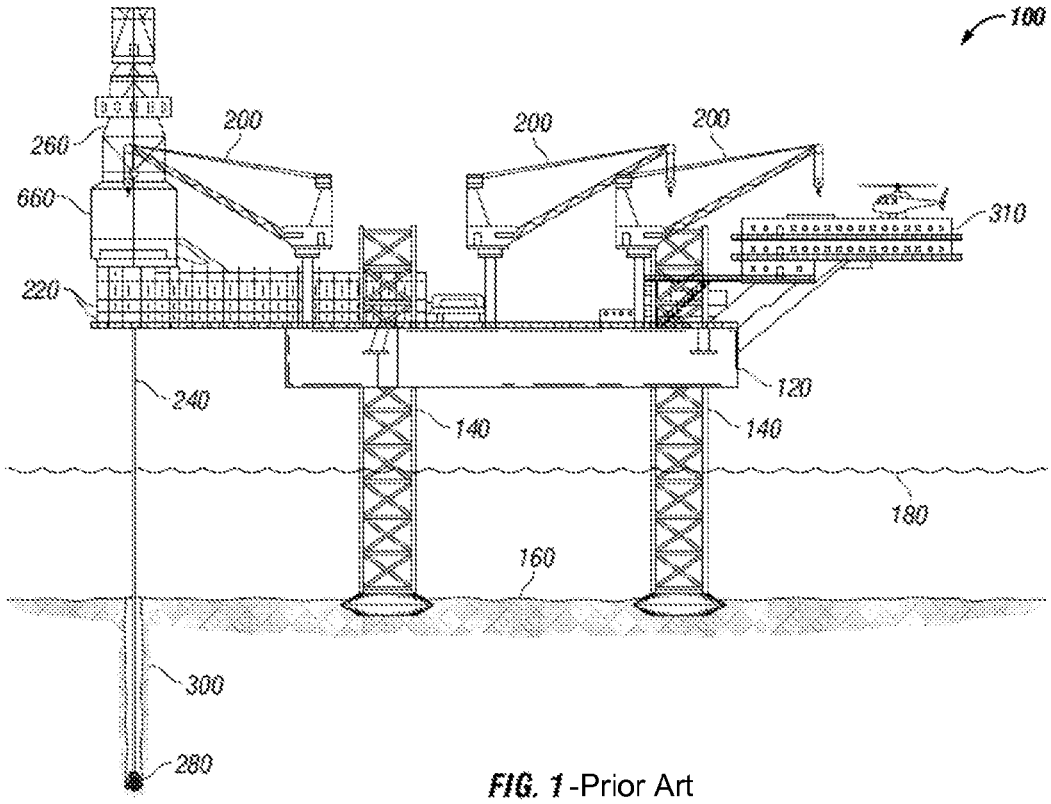
FIG. 1 -Prior Art
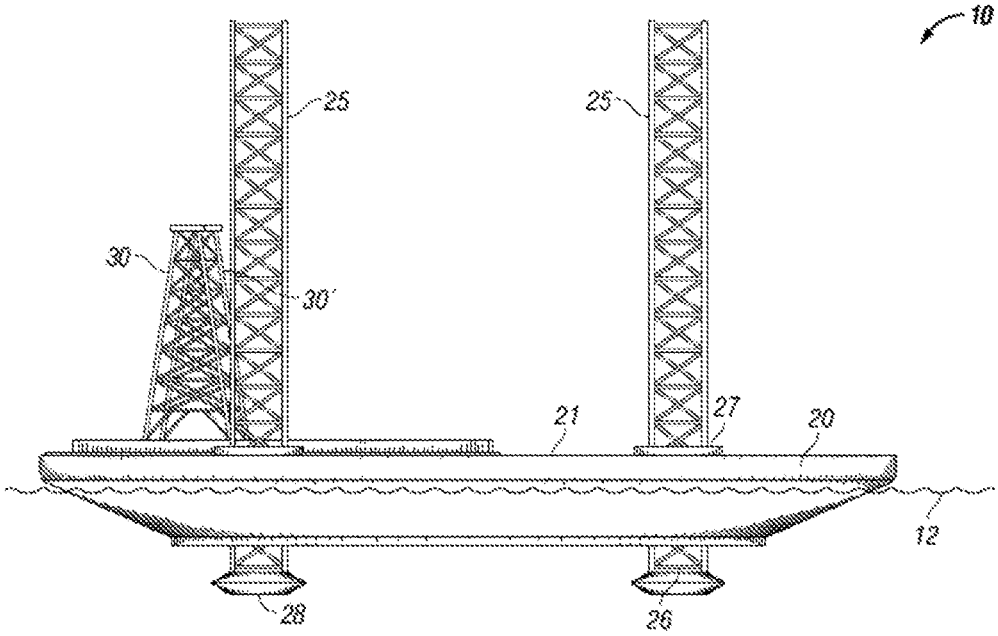
FIG. 2

DUAL-DERRICK ICE-WORTHY JACK-UP DRILLING UNIT

PRIOR RELATED APPLICATIONS

This application is a continuation of International Application No. PCT/SG2011/000369, filed on Oct. 21, 2011, which claims priority to U.S. Application No. 61/405,497, filed on Oct. 21, 2010, both are incorporated by reference in their entirety herein.

FIELD OF THE INVENTION

This invention relates to mobile offshore drilling units, often called "jack-up" drilling units or rigs that are used in shallow water, typically less than 400 feet, for exploratory or development drilling for hydrocarbons.

BACKGROUND OF THE INVENTION

In the never-ending search for hydrocarbons, many technologies have been developed to find new reservoirs and resources and most areas of the world have been scoured looking for new discoveries. Few expect that any large, undiscovered resources remain to be found near populated areas and in places that would be easily accessed. Instead, new large reserves are being found in more challenging and difficult to reach areas.

One promising area is in the offshore Arctic. However, the Arctic is cold, remote and ice on the water creates considerable challenges for prospecting for hydrocarbons. Over the years, it has generally been regarded that six unprofitable wells must be drilled for every profitable well. If this is actually true, one must hope that the unprofitable wells will not be expensive to drill. However, little in the Arctic is inexpensive.

Currently, in the shallow waters of cold weather places like the Arctic, exploratory drilling from a jack-up or mobile offshore drilling unit (MODU) can be used for about 45-90 days in the short, open-water summer season. Predicting when the drilling season starts and ends is a game of chance and many efforts are undertaken to determine when the jack-up may be safely towed to the drilling location and drilling may be started. Once started, there is considerable urgency to complete the well to avoid having to disconnect and retreat in the event of ice incursion before the well is complete. Even during the few weeks of open water, ice floes present a significant hazard to jack-up drilling rigs on location and legs of the jack-up drilling rig are exposed and quite vulnerable to damage.

Jack-up rigs are mobile, self-elevating, offshore drilling and workover platforms equipped with legs that can be lowered to the ocean floor until a foundation is established to support the hull, which contains the drilling and/or workover equipment, jacking system, crew quarters, loading and unloading facilities, storage areas for bulk and liquid materials, helicopter landing deck and other related equipment.

The jack-up rig is designed to be towed to the drilling site and jacked-up out of the water so that the wave action only impacts the legs, which have a fairly small cross section. However, the legs of a jack-up provide little defense against ice floe collisions and an ice floe of any notable size is capable of causing structural damage to one or more legs and/or pushing the rig off location. If this type of event were to happen before the drilling operations were suspended and suitable secure and abandon had been completed, a hydrocarbon leak would possibly occur. Even a small risk of such a leak is completely unacceptable in the oil and gas industry, to the regulators and to the public.

Thus, once it is determined that a potentially profitable well has been drilled during this short season, a very large, gravity based production system, or similar structure may be brought in and set on the sea floor for the long process of drilling and producing the hydrocarbons. These gravity-based structures are very large and very expensive, but are built to withstand the ice forces year around.

U.S. Pat. No. 4,819,730 discloses a floating work platform that has two derricks provided thereon. However, that patent is directed to a semi-submersible vessel, such as a drill ship. Unlike jack-up rigs, semi-submersible vessels by nature are subject to both the wave and impact of ice floe, and therefore cannot withstand the extreme conditions in the Artic.

EP1094193 discloses a offshore drilling ship that has a dual-activity drilling assembly, so that the time involved in drilling wells in substantially deep water can be reduced. However, this patent is also directed to a drilling ship that cannot maintain high stability required in the Artic under harsh weather conditions. Additionally, the dual-activity drilling assembly disclosed can only drill one well at a time, which is inherently inefficient for exploration or production purposes, especially at a place where only a very narrow window of operation is available.

U.S. Pat. No. 6,491,477 describes a self-elevating drilling unit with dual cantilever assemblies that permit dual drilling on a small platform where each drilling unit can operate on an 8×8 spacing. However, this rig is still subject to the vagaries of weather and does not solve the ice problem that exists in Artic or North sea drilling.

Therefore, there is the need for a drilling system and method that can both withstand the extreme conditions in the Artic and provide highly efficient exploration capacity and mobility.

SUMMARY OF THE INVENTION

The invention relates to an improved jack-up rig for exploratory drilling for hydrocarbons in potential ice conditions in offshore areas, including a flotation hull having two derricks on a deck thereof, as well as an ice defensive shape or portion of the flotation hull that serves to bend and break or deflect ice away from the legs.

For some embodiments, the flotation hull includes an ice bending shape along the lower portion thereof and extending around a periphery of the flotation hull. The ice-bending shape extends from an area of the hull near the level of the deck or the bottom thereof and extends downwardly and tapers inwardly near the bottom. The ice hull can double or triple the drilling season, and thus is of tremendous value.

The ice bending shape can include an optional ice deflecting portion extending around the bottom perimeter of the bottom ice-bending shape to direct ice around and not under the hull. This deflecting portion is generally vertical, but can be within 5-10 degrees off vertical, and can have an optional flared outward bottom-most end. This ice deflecting portion can be part of the flotation hull (thus contribute to the buoyancy volume), or can depend downwardly from the flotation hull as a protruding edge.

Generally, the ice bending portion of the hull is composed of flat plates (chined), for ease and cost of manufacture, but this is not essential, and smooth curved surfaces, and combinations thereof are also included within the scope of the invention.

The rig further includes at least three or four legs that are positioned within the perimeter of the hull, wherein the legs are arranged to be lifted up off the seafloor so that the rig may be towed through shallow water and also extend to the sea floor and extend further to lift the hull partially or fully out of the water. A jack is associated with each leg and functions to raise and lower the legs as needed.

The legs can be open-truss legs—a design that resemble electrical towers made of crisscrossed tubular steel sections. The legs can also be columnar legs made of large steel tubes. While columnar legs are less expensive than open-truss legs to fabricate, they are less stable and cannot adapt to stresses in the water as well as open-truss legs. For this reason, columnar-legged jack-ups are not used in waters that measure more than 250 feet deep.

The jack-up rig further comprises at least two derricks mounted on the deck. The derricks are positioned at the same side, or preferably opposite sides of the deck for improved balance. In the case where the two derricks are positioned at the same side of the deck, an additional balancing means can be provided at the opposite side of the deck opposing the two derricks, but may not be needed if a single balance means is properly positioned between the two. In this embodiment, at least four legs can be employed. The dual derrick system doubles the drilling potential of the rig, particularly when direction drilling is employed.

The jack-up rig can be a slot-type jack-up, also known as a keyway jack-up. Drilling slot jack-ups are built with an opening or moon pool in the drilling deck, and the derrick is positioned over it. However, the preferred design is the cantilevered jack-up. Here, the drilling derrick is mounted on an arm that extends outward from the drilling deck. With a cantilevered jack-up, drilling can be performed through existing platforms, as well as outside them. Because of the range of motion that the cantilever provides, most jack-ups built in the last 10 years have been cantilevered jack-ups.

The invention further relates to a method for exploratory or development drilling in ice prone waters where wells are drilled to determine the existence and economic viability of hydrocarbon reserves in an under sea reservoir. The method includes towing to the prospect site a flotation hull having a relatively flat deck at the upper portion thereof and an ice bending shape along the lower portion thereof. The ice bending shape tapers downwardly and inwardly.

At least three legs are positioned inside the perimeter of the hull. Each leg is jacked down so that the legs engage the sea floor and lift the hull up and fully out of the water when ice is not threatening the rig. The ice hull also can be lowered into the water into an ice defensive configuration so that the ice bending shape extends both above and below the sea surface to bend and breaks any ice that floats against the rig. Drilling from the dual derricks can occur during either of these stages, and thus drilling potential is at least 400-600% improved over single derrick, skirt-less rig designs, particularly when directional drilling in different directions on the two derricks is employed.

As used herein, the term "ice-bending" refers to the shape of the floating ice hull and the angle between the hull and seawater, which are designed such that ice coming into contact with the ice hull will be bent and broken into smaller pieces due to the local confinement by the ice bending shape and continuous buoyant force exerted by the seawater. These opposing forces result in the accumulation of stress and breakage of the ice. Thus, the ice-bending hull generally extends inwardly with depth, such that the higher portions are larger, and the lower portions smaller, as with a tapered ship's hull.

As used herein, "shallow water" refers to water having depth from the sea floor of no more than 400 feet.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention.

BRIEF DESCRIPTION OF THE DRAWINGS

FIG. 1 is an exemplary prior art drilling rig.

FIG. 2 is an elevation view of a first embodiment of the present invention where the drilling rig is floating in the water and available to be towed to a well drilling site.

In FIG. 9B, generally vertical edge 97 is inside or a part of the double walled floatation hull 97.

DESCRIPTION OF EMBODIMENTS OF THE INVENTION

Figure 3:
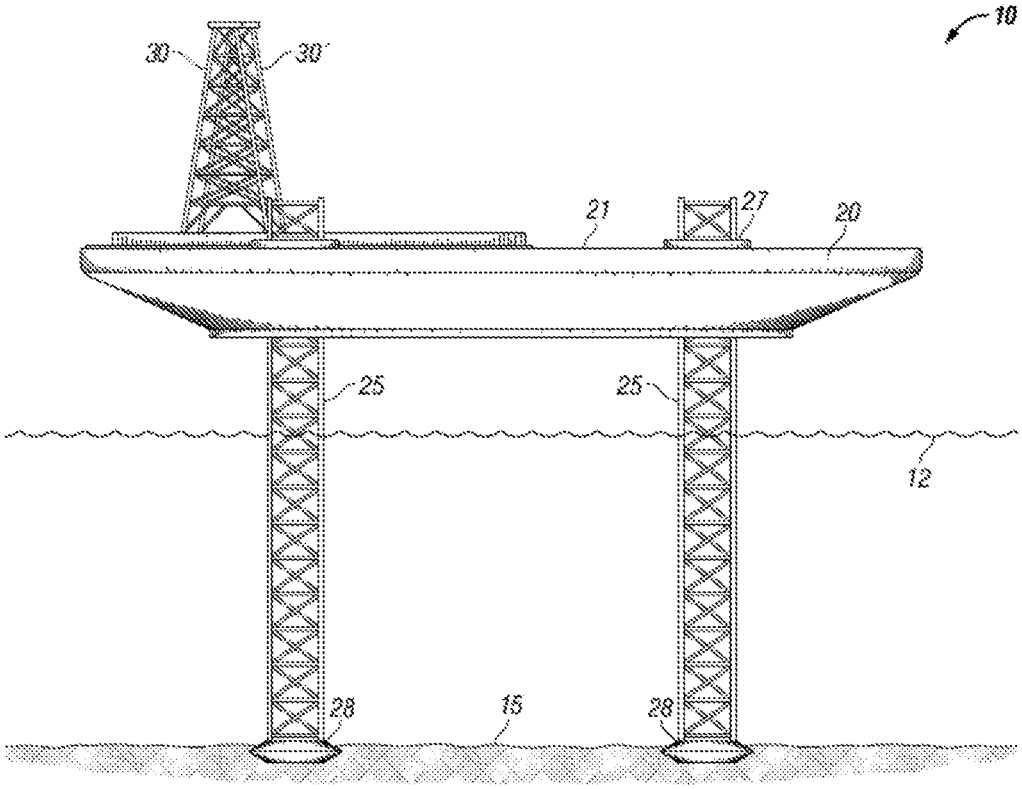
FIG. 3 is a second elevation view of the first embodiment of the present invention where the drilling rig is jacked up out of the water for conventional open water drilling.

The present invention is exemplified with respect to jack-up rigs having both ice-protection capability and at least two derricks mounted on the deck. Generally speaking, the hull has a least an ice bending portion that circumnavigates the hull and tapers inwardly as it downwardly depends from the deck near its periphery. There can also be a roughly vertical edge or ice deflector at the bottom of the ice bending portion that prevents ice from slipping under the hull, and instead deflects it around the hull. An outwardly tipped lip at the very base of the ice deflector may also be beneficial in deflecting ice.

Generally the ice breaking portion of hull should be a thick steel (25-50 mm thick), but thickness can be minimized if reinforced on the internal side with extra internal ribbing, and/or an additional secondary hull positioned inside the external hull. It is known in ice breaking ship art how to frame a hull with transverse, longitudinal or oblique framing members, and vary shell plate thickness according to framing style, distance between framing ribs, peak pressures and patch pressures, etc. (see e.g., GUIDANCE NOTES ON ICE CLASS, published by American Bureau of Shipping Incorporated by Act of Legislature of the State of New York 1862 (2008) (incorporated herein by reference). Specially formulated hull polymer paints for strength and low friction can be used to coat the ice skirt. In particular, Intershield 163 Inerta 160 by INTERNATIONAL MARINE COATINGS® may be a preferred coating.

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

EXAMPLE 1

FIG. 1 is a prior art drilling rig 100 which shows a jack-up rig in more detail, including the elevated hull 120 lifted above waterline 180 via legs 140, heliport 310, cranes 200, cantilevered drill portion 220 having derrick 260 with drill floor 660, and drill string 240 descending into open hole 300 past the sea floor 160 and ending in drill bit 280. Spud cans are also shown, but not labeled. Considerable detail is omitted from this figure, including various safety and control systems, piping, crew quarters, marine equipment, mission equipment, and elevating equipment, but it can be seen that a jack-up rig has limited space and complex structure. Hereinafter, the jack-up rig figures are simplified somewhat for clarity of viewing.

As shown in FIG. 2, an ice worthy jack-up rig is generally indicated by the arrow 10. In FIG. 2, jack-up rig 10 is shown with its hull 20 floating in the sea and legs 25 in a lifted arrangement where much of the length of the legs 25 extend above the deck 21 of the hull 20. On the deck 21 are derricks 30, 30', which are used to drill wells. In the configuration shown in FIG. 2, the jack-up rig 10 may be towed from one prospect field to another and to and from shore bases for maintenance and other shore service.

When the jack-up rig 10 is towed to a prospective drilling site in shallow water, the legs 25 are lowered through the openings 27 in hull 20 until the feet 26 at the bottom ends of the legs 25 engage the seafloor 15 as shown in FIG. 3. In a preferred embodiment, the feet 26 are connected to spud cans 28 to secure the rig 10 to the seafloor. Alternatively, mats may be used (not shown). Once the feet 26 engage the seafloor 15, jacking rigs or elevation means within openings 27 push the legs 25 down and therefore, the hull 20 is lifted out of the water. With the hull 20 fully jacked-up and out of the water, any wave action and heavy seas more easily break past the legs 25 as compared to the effect of waves against a large buoyant object like the hull 20. As shown in FIG. 3, well drilling operations may commence in the ordinary course while there is no ice in the area.

Figure 4:
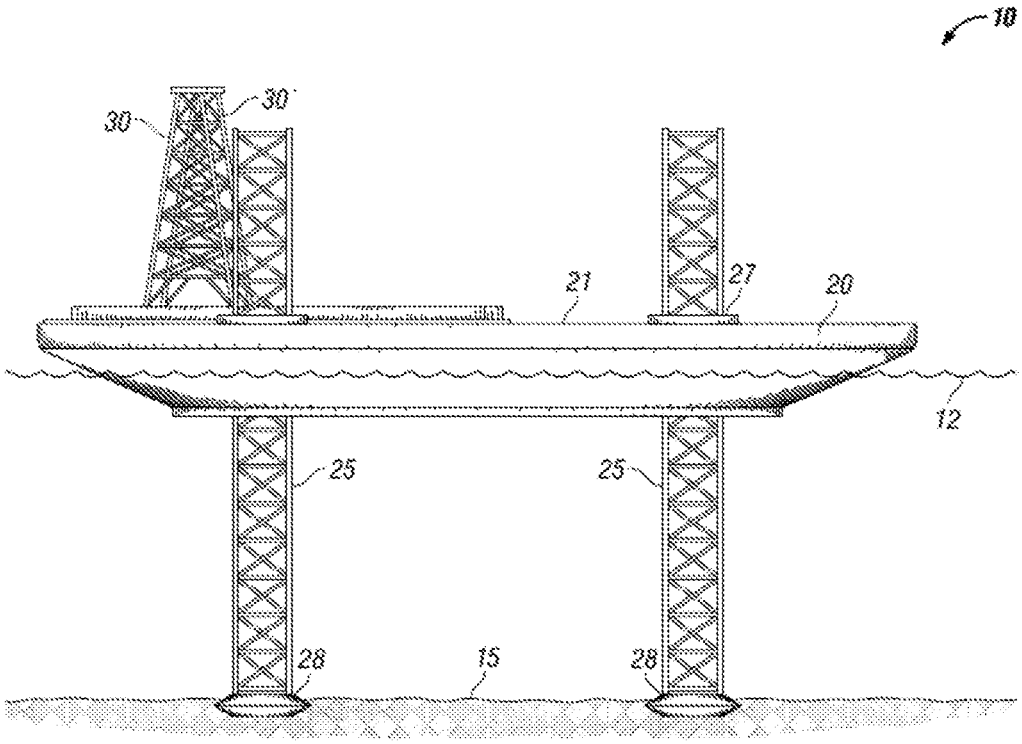
FIG. 4 is a second elevation view of the first embodiment of the present invention where the drilling rig is partially lowered into the ice/water interface, but still supported by its legs, in a defensive configuration for drilling during potential ice conditions.

However, when ice begins to form on the sea surface 12, the risk of an ice floe contacting and damaging the legs 25 or simply bulldozing the jack-up rig 10 off the drilling site becomes a significant concern for conventional jack-up rigs and such rigs are typically removed from drill sites by the end of the open water season. The ice-worthy jack-up drilling rig 10 is designed to resist ice floes by assuming an ice defensive, hull-in-water configuration as shown in FIG. 4. In FIG. 4, ice tends to dampen waves and rough seas, so the sea surface 12 appears less threatening, however, the hazards of the marine environment have only altered, and not lessened.

When the ice-worthy jack-up rig 10 assumes its ice defensive, hull-in-water configuration, the hull 20 is lowered into the water to contact same, but not to the extent that the hull 20 would begin to float. A significant portion of the weight of the rig 10 preferably remains on the legs 25 to hold the position of the rig 10 on the drill site against any pressure an ice floe might bring. The rig 10 is lowered so that inwardly sloped, ice-bending surface 41 (shown in FIG. 5A) bridges the sea surface 12 or ice/water interface to engage any floating ice that may come upon the rig 10.

Figure 5A:
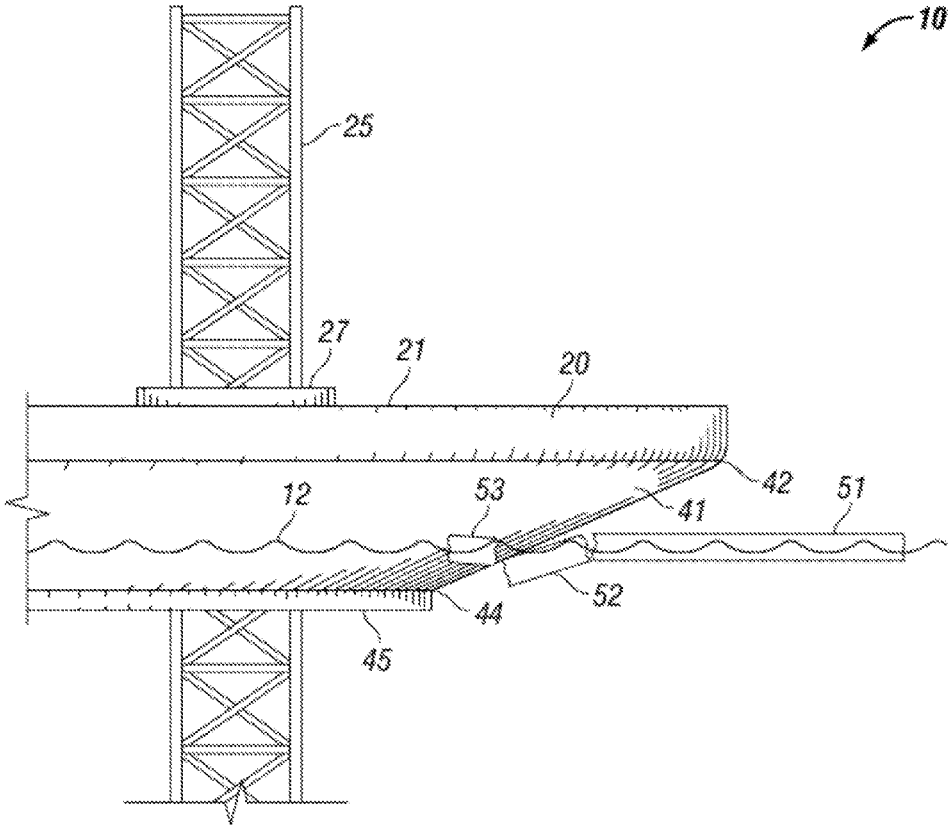
FIG. 5*a* is an enlarged fragmentary elevation view showing one end of the first embodiment of the present invention in the FIG. 3 configuration with ice moving against the rig.

FIG. 5A shows a close up of one edge of the ice hull. The sloped ice-bending surface 41 runs from shoulder 42 down to neckline 44. Ice deflector 45 extends downward from neckline 44, and can be roughly vertical or within 5-10 degrees thereof.

Ice has substantial compressive strength being in the range of 4 to 12 MPa, but is much weaker against bending with typical flexure strength in the range of 0.3 to 0.5 MPa. As shown in FIG. 5*a*, the force of the ice floe 51 moving along the sea surface 12 causes the leading edge to slide under the sea surface 12 and caused sections 52 and 53 to break off. The smaller sections tend to float past and around the rig 10 without applying the impact of a large floe. For example, it is conceivable that an ice floe being hundreds of feet across could come toward the rig 10. If the ice floe is broken into bits that are less than twenty feet in the longest dimension, such bits are able to pass around the rig 10 with much less concern.

Figure 5B:
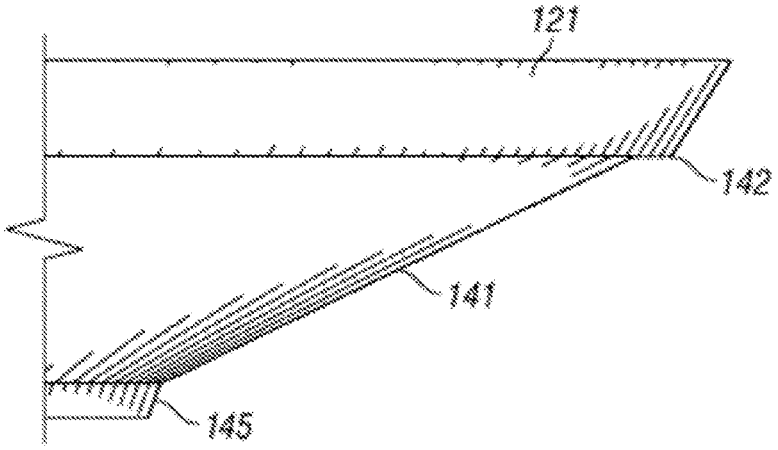
FIGS. 5*b* is an enlarged fragmentary elevation view showing one end of the second embodiment of the ice hull.
Figure 5C:
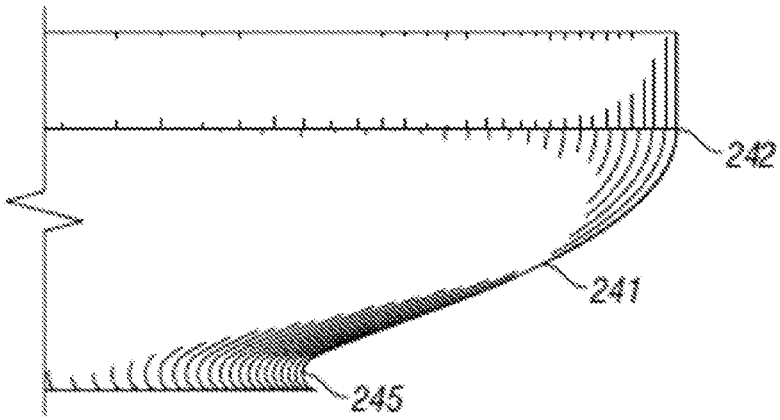
FIG. 5*c* is an enlarged fragmentary elevation view showing one end of the third embodiment of the ice hull.
Figure 5D:
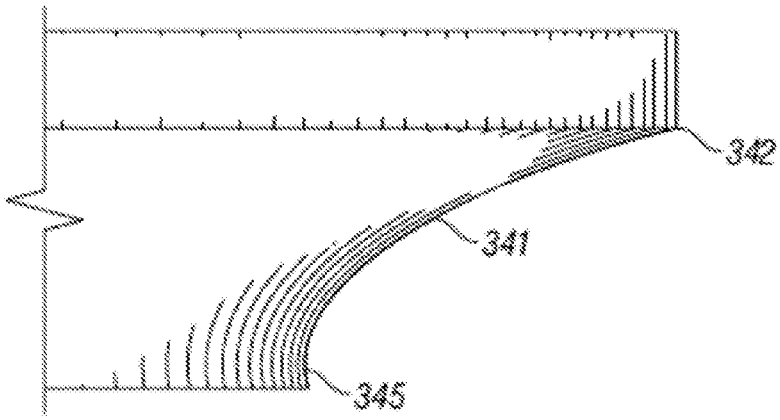
FIG. 5*d* is an enlarged fragmentary elevation view showing one end of the fourth embodiment of the ice hull.

Other ice bending shapes are contemplated, as shown in FIGS. 5B-D. FIG. 5B shows a lightly off vertical (−10°) ice deflector portion 145, wherein the ice bending shape 141 is slightly inset from the shoulder 142 of flotation hull 121, which in this case also has an sloping upper edge above shoulder 142. The flotation hull is preferably a double-walled hull with reinforcing beams therebetween to better withstand the impact of ice floe. FIG. 5C shows a convex ice bending shape 241, with outward trending curved lip on the ice deflector 245 for ice recoil. FIG. 5D shows a concave ice bending shape 341 with a similar outwardly deflecting end 345.

To additionally resist the forces that an ice floe may impose on the rig 10, the feet 26 of the legs may be arranged to connect to cans 28 set in the sea floor so that when an ice floe comes against the ice-bending surface 41, the legs 25 actually hold the hull 20 down and force the bending of the ice floe and resist the lifting force of the ice floe which, in an extreme case, may lift the near side of the rig 10 and push the rig over on its side by using the feet 26 on the opposite side of the rig 10 as the fulcrum or pivot. The cans in the sea floor are known for other applications and the feet 26 would include appropriate connections to attach and release from the cans, as desired.

It should probably be noted that shifting from a conventional open water drilling configuration as shown in FIG. 3 to a hull-in-water, ice defensive configuration shown in FIG. 4 may require considerable planning and accommodation depending on what aspect of drilling is ongoing at the time. While some equipment can accommodate shifting of the height of the deck 21, other equipment may require disconnections or reconfiguration to adapt to a new height off the sea floor 15.

The ice-worthy jack-up drill rig 10 is designed to operate like a conventional jack-up rig in open water, but is also designed to settle to the water in an ice defensive position and then re-acquire the conventional stance or configuration if and when wave action becomes a concern. It is the shape of the ice hull 20 (as well as its strength) that provides ice bending and breaking capabilities.

Figure 6A:
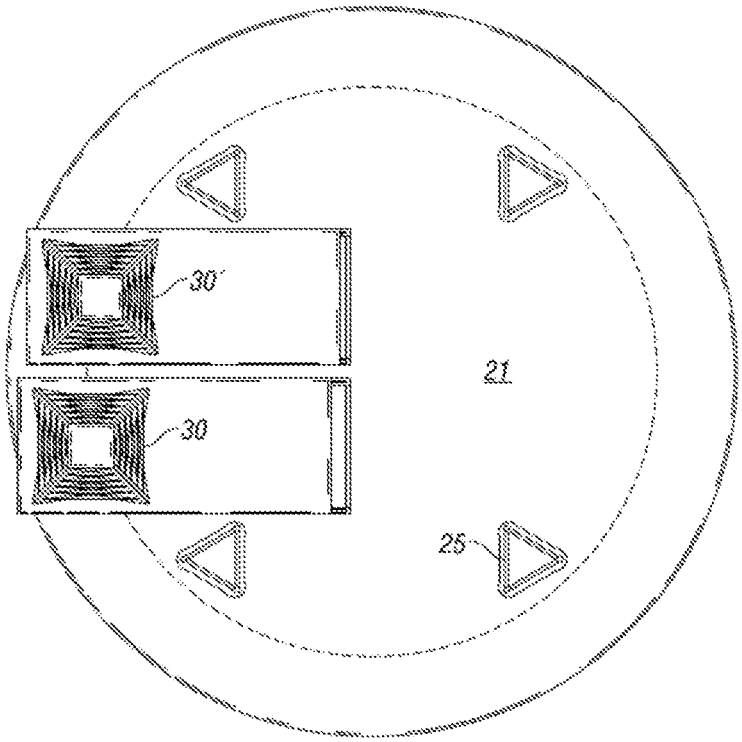
FIG. 6*a* is a top view of the first embodiment of the present invention where a cantilever derrick is positioned to drill through a moon pool.
Figure 6B:
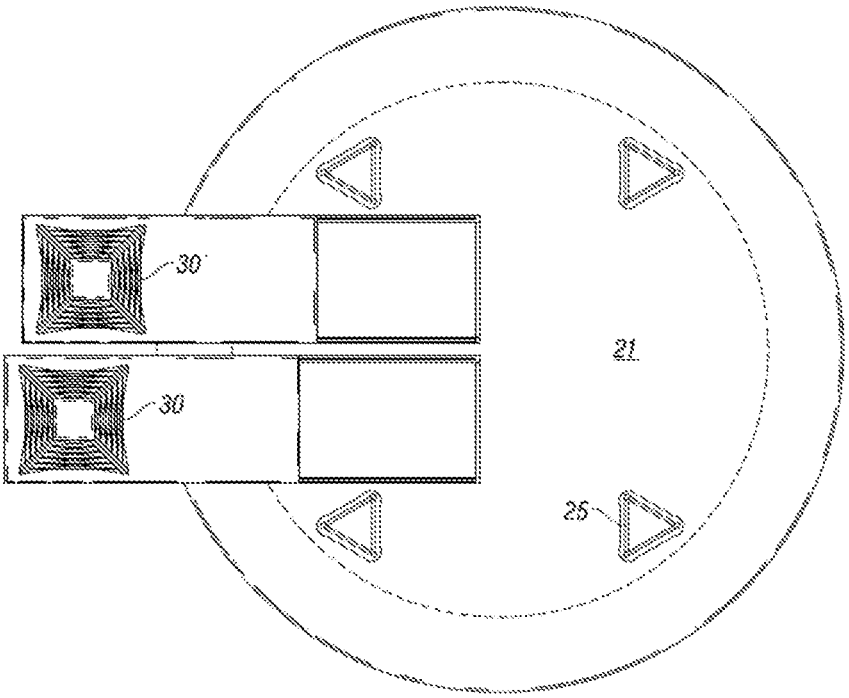
FIG. 6*b* is a top view of the first embodiment of the present invention where a cantilever derrick is positioned to drill over the edge of the deck.
Figure 7:
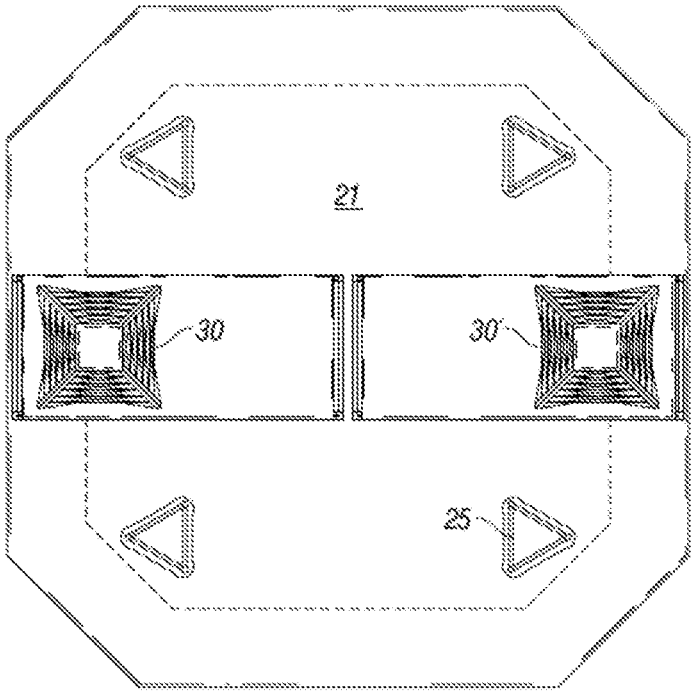
FIG. 7 is a top view of a second embodiment of the present invention wherein the derricks are positioned opposite one another.

Referring to FIGS. 6A-B and 7, the hull perimeter may have a circular, oval or pointed oval configuration (football shaped, not shown) or polygonal so as to present a shape that is conducive to steering the broken bits and sections of ice around the periphery of the rig 10 regardless of the direction of origin or path of travel. The ice tends to flow with the wind and sea currents, which tend not to be co-linear, or some paths reflecting influences of both sea and air.

As shown in FIG. 7, the hull may have a faceted or multi-sided shape that provides the advantages of a circular or oval shape, but may be less expensive to construct because flat plates could be used in its construction. However, this may not be essential, and curved ice hull shapes are shown in FIGS. 5C-D.

The ice-breaking surface 41 would preferably extend at least about five meters above the water level, recognizing that water levels shift up and down with tides and storms and perhaps other influences. The height above the water level accommodates ice floes that are quite thick or having ridges that extend well above the sea surface 12, but since the height of the shoulder 42 is well above the sea surface 12, the tall ice floes will be forced down as they come into contact with the rig 10. At the same time, the deck 21 at the top of the hull 20 should be far enough above the water line so that waves are not able to wash across the deck. As such, the deck 25 is preferred to be at least 7 to 8 meters above the sea surface 12. Conversely, the neckline 42 is preferred to be at least 4 to 8 meters below the sea surface 12 to adequately bend the ice floes to break them up into more harmless bits. Thus, the total floating ice hull height is preferably in the range of 5-20 meters, preferably 8-16 meters or 11-16 meters.

It should also be noted that the legs 25 and the openings 27 through which they are connected to the hull 20 are inside the protective ice deflector 45 circumference so that the ice floes are less likely to contact the legs while the rig 10 is in its defensive ice condition configuration as shown in FIGS. 4 and 5A, and sometimes called hull-in-water configuration. Moreover, the rig 10 does not have to handle every ice floe threat to significantly add value to oil and gas companies. If rig 10 can extend the drilling season by as little as a month, that would be a fifty percent improvement in some ice prone areas and therefore provide a very real cost saving benefit to the industry.

Referring to FIGS. 6A and B, the derricks 30, 30' may be positioned to drill through a moon pool that is within the perimeter of the ice deflector 45 as shown in FIG. 6A or may be arranged to drill over the side of the deck 21 in a cantilevered fashion as shown in FIG. 6B. FIGS. 7 shows a similar layout, but with a polygonal hull in top view. Note that although most Figures show a 3-chorded leg, four chorded legs can also be used.

Figure 8A:
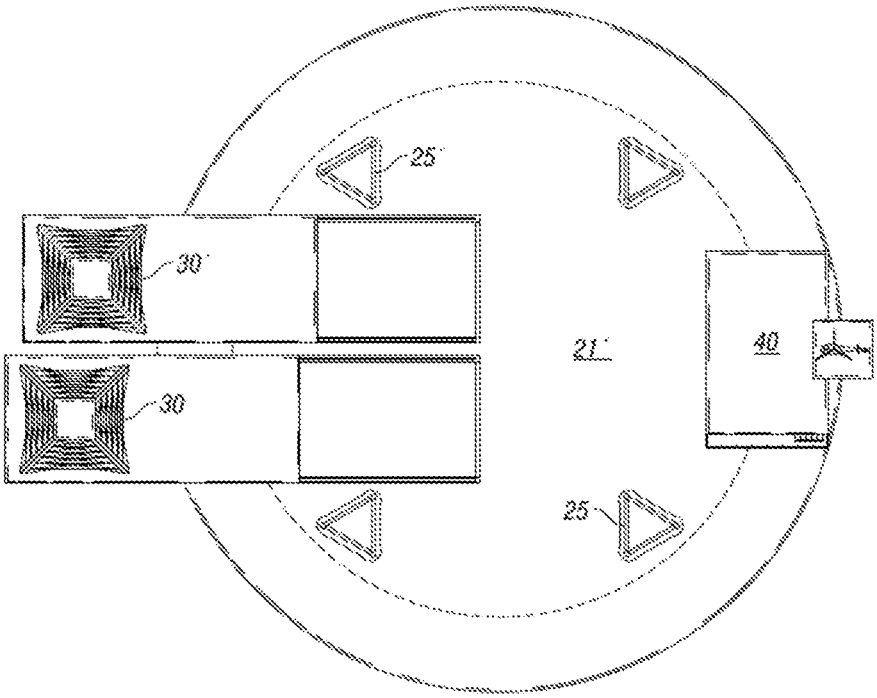
FIG. 8*a* is a top view of another embodiment of the present invention where two cantilever derricks are positioned at the left side of the deck, and an accommodation unit is positioned at the right side of the deck.
Figure 8B:
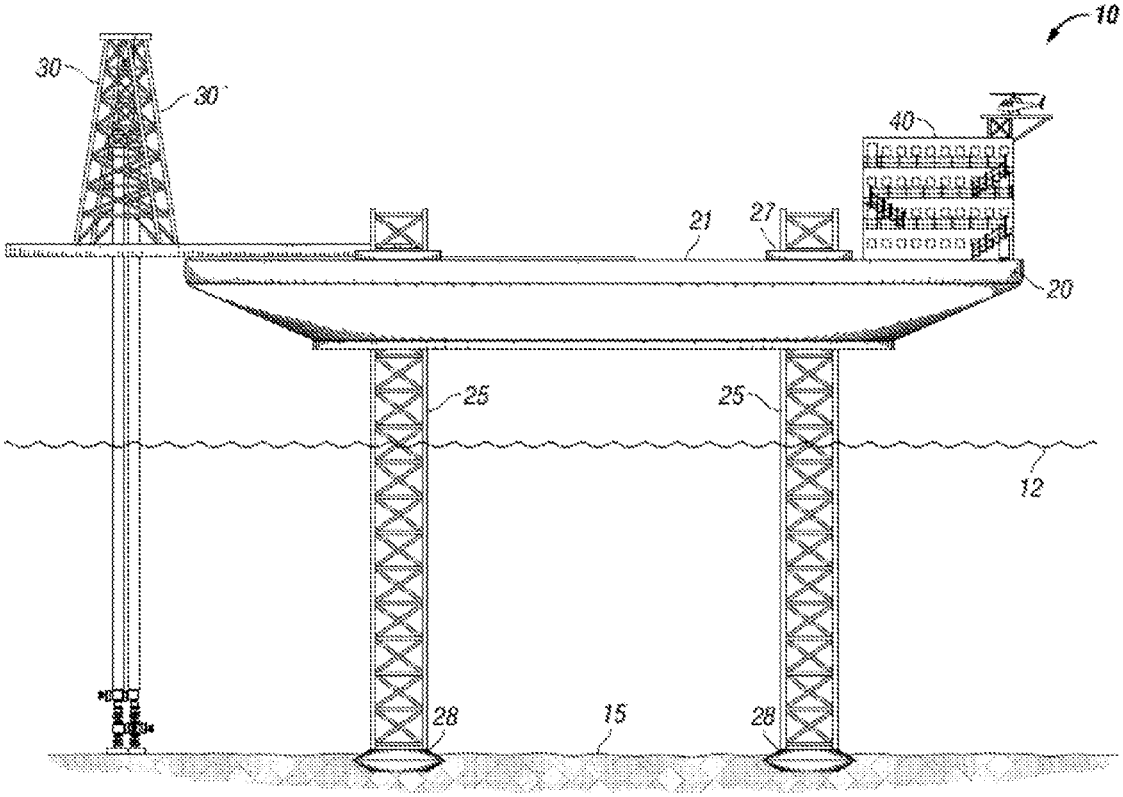
FIG. 8*b* is an elevation view of the embodiment shown in FIG. 8*a*, wherein the derricks have been cantilevered over the edge of the deck for use.
Figure 9A:
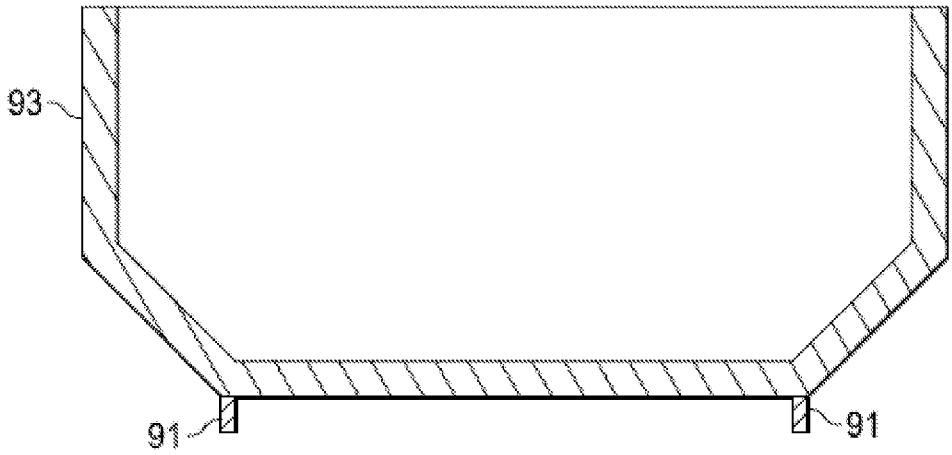
FIG. 9A shows a cross section of a double walled hull 93, wherein generally vertical edge 91 is outside the floatation hull 93 in FIG. 9A.
Figure 9B:
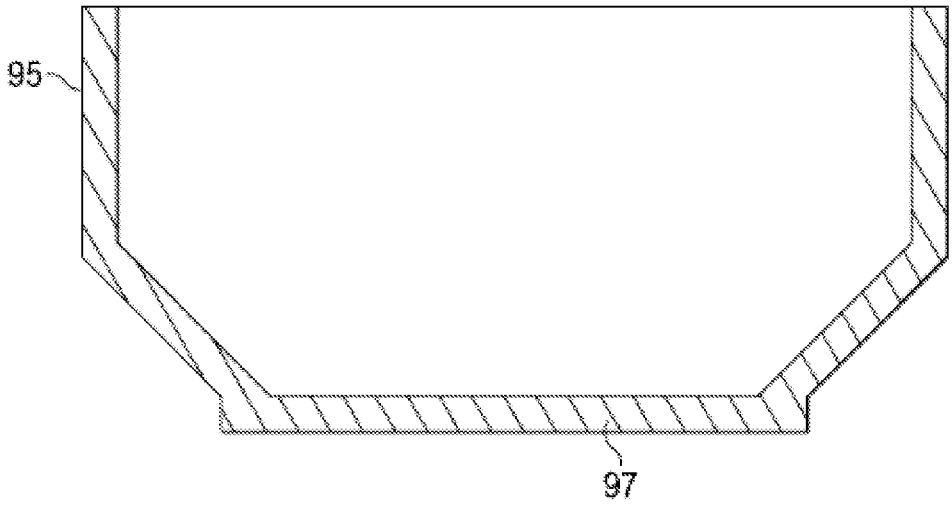
FIG. 9B shows an alternative cross section of a double walled hull 95.

Referring to FIGS. 8A and 8B, another embodiment of the present invention with two drilling rigs is discussed. As mentioned above, because open water season in the Artic is so short, it is desirable to improve the exploration efficiency. Thus, a first derrick 30 and a second derrick 30' are provided side by side on one end the deck 21' of the jack-up rig. The derricks 30, 30' are operated in the cantilevered fashion so as to drill wells directly through seawater. However, the derricks 30, 30' may also be arranged to drill through moon pools that are within the perimeter of the ice deflector. Additionally, because the derricks and cantilever have considerable weight, for them to be safely and stably positioned on the deck, an accommodation module 40 is also provided on the deck 21', and preferably at the opposite end of the two derricks. In this arrangement, the accommodation module provides balance to the two derricks, 30, 30'. Of course, the derricks need not be side by side, but can be opposite one another as shown from top view in FIG. 7.

The design and operation of such dual-derrick jack-up rig is sophisticated, mostly because of the limited deck space and the rough conditions in the Artic. The bigger and heavier the jack-up rig is, the harder it is to jack up and maintain the balance of the rig. As can be appreciated, the placement of the derricks and the accommodation module is thus very crucial to a safe and efficient operation. The number and placement of the legs 25 relative to the derricks and/or the accommodation module 40 may also vary depending on the weight, space and arrangement of equipment mounted on the deck.

Preferably, to have better balance, at least four legs 25 are used. Additional legs can also be provided if space allowed, but more legs also means more areas will be subject to the impact of waves and ice floe, and therefore optimizing the number and placement of legs are of crucial importance.

With the ice-bending feature and dual-derrick capability in the jack-up rig, the present invention provides an efficient, safe and productive way to significantly improve the exploration of oil and gas reserves in the Artic. Compared to conventional jack-up rigs, the present invention can prolong the operational period during the open water season by breaking the ice floe into smaller pieces, and also double the exploration capacity by employing two derricks on the rig, resulting in significant savings in the exploration operations.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

The following references are incorporated by reference in their entirety.

1. U.S. Pat. No. 4,819,730
2. EP1094193
3. U.S. Pat. No. 6,491,477
4. *GUIDANCE NOTES ON ICE CLASS*, published by American Bureau of Shipping Incorporated by Act of Legislature of the State of New York 1862 (2008).

5. Requirements concerning *POLAR CLASS*, by INTERNATIONAL ASSOCIATION OF CLASSIFICATION SOCIETIES (2011).

What is claimed is:

1. A drilling jack-up rig comprising:

i) a flotation hull having a generally flat upper deck;

ii) an ice-bending portion of said flotation hull extending downwardly from at or near a periphery of said deck and tapering inwardly, wherein said ice bending portion has a shape and a strength sufficient to provide ice bending and breaking capabilities against an ice floe;

iii) an optional ice deflecting edge extending generally vertically down from a bottom periphery of said ice-bending portion to direct ice around and not under said flotation hull;

iv) at least three legs that are positioned within a perimeter of said flotation hull;

v) a jack-up device associated with each leg to raise and lower each leg; and vi) at least two derricks mounted on said deck;

wherein said at least two derricks are positioned on the same horizontal side on said deck relative to a first centerline of the deck, and opposite horizontal sides of the deck relative to a second centerline of the deck perpendicular to the first centerline or at the opposite horizontal sides of said deck equidistant from a center of the deck.

2. The jack-up rig according to claim 1, wherein two derricks are positioned on the same horizontal side of the deck.

3. The jack-up rig according to claim 2, further comprising an accommodation unit mounted at the opposite horizontal side of the two derricks on said deck and away from the center of the deck.

4. The jack-up rig according to claim 1, wherein two derricks are positioned at the opposite horizontal sides of said deck.

5. A drilling jack-up rig comprising:

i) a flotation hull having a generally flat upper deck;

ii) an ice-bending portion of said flotation hull extending downwardly from at or near a periphery of said deck and tapering inwardly, wherein said ice bending portion has a shape and a strength sufficient to provide ice bending and breaking capabilities against an ice floe;

iii) an optional ice deflecting edge extending generally vertically down from a bottom periphery of said ice-bending portion to direct ice around and not under said flotation hull;

iv) at least three legs that are positioned within a perimeter of said flotation hull;

v) a jack-up device associated with each leg to raise and lower each leg; and vi) at least two derricks mounted on said deck, wherein the ice-bending portion extends vertically at least 11 to 16 meters, and wherein the angle of the ice-bending hull is in the range of 5-10 degrees from the vertical.

* * * * *